US005720482A

United States Patent [19]

Boudrias

[11] Patent Number: 5,720,482

[45] Date of Patent: Feb. 24, 1998

[54] BOARD-TYPE GOLF GAME

[76] Inventor: Robert Boudrias, 246 Sherwood Dr., Pointe Claire, Quebec, Canada, H9R 2R8

[21] Appl. No.: 835,685

[22] Filed: Apr. 10, 1997

[51] Int. Cl.[6] ..... A63F 3/00

[52] U.S. Cl. ..... 273/245; 273/431

[58] Field of Search ..... 273/245, 429, 273/430, 431, 432

[56] References Cited

U.S. PATENT DOCUMENTS

| | | | |
|---|---|---|---|
| 673,080 | 4/1901 | Hill . | |
| 1,546,837 | 10/1925 | Johnson . | |
| 1,638,365 | 8/1927 | Ryan | 273/245 |
| 4,042,246 | 8/1977 | Strandgard . | |
| 4,277,065 | 7/1981 | White | 273/245 |
| 5,000,460 | 3/1991 | Barbiaux et al. | 273/245 |
| 5,123,653 | 6/1992 | Murphy et al. | 273/431 X |
| 5,470,077 | 11/1995 | Brewster et al. | 273/245 |
| 5,501,456 | 3/1996 | Collins et al. | 273/430 X |

*Primary Examiner*—William E. Stoll

*Attorney, Agent, or Firm*—Swabey Ogilvy Renault

[57] ABSTRACT

A board-type golf game is comprised of a board having opposed playing surfaces and on which is delineated a plurality of golf links. Each link has a tee area, a fairway area, a green area and representations of golf hazards. Numbered landing markers are associated with these areas. The landing markers on the green area are colored and these colors are associated with various degrees of difficulty of golf skill testing questions which are provided on skill testing cards. The skill testing cards are provided in groups and each of the groups is associated with a particular number of die throws that a player obtains before landing his pawn piece on the green. The player pawn pieces are advanced on the fairway and through the hazards by the numbers obtained by throwing one or two dies. The number of putting strokes calculated on the green depends on the answers given to the questions contained in the skill testing cards.

17 Claims, 4 Drawing Sheets

| Name | 1 | 2 | 3 | 4 | 5 | 6 | 7 | 8 | 9 | 10 | 11 | 12 | 13 | 14 | 15 | 16 | 17 | 18 | Total |
|---|---|---|---|---|---|---|---|---|---|---|---|---|---|---|---|---|---|---|---|
| | | | | | | | | | | | | | | | | | | | |
| | | | | | | | | | | | | | | | | | | | |
| Hdcp | 3 | 9 | 13 | 17 | 1 | 5 | 15 | 11 | 7 | 4 | 6 | 10 | 8 | 18 | 16 | 12 | 2 | 14 | |
| | | | | | | | | | | | | | | | | | | | |
| | | | | | | | | | | | | | | | | | | | |
| | | | | | | | | | | | | | | | | | | | |

Fig. 4A

| Name | 1 | 2 | 3 | 4 | 5 | 6 | 7 | 8 | 9 | 10 |
|---|---|---|---|---|---|---|---|---|---|---|
| | | | | | | | | | | |
| | | | | | | | | | | |
| | | | | | | | | | | |
| | | | | | | | | | | |
| | | | | | | | | | | |

HDCP

Fig. 4B

BOARD-TYPE GOLF GAME

TECHNICAL FIELD

The present invention relates to a board-type golf game which is played with a numerical chance means whereby to displace pawn pieces on landing markers provided on a fairway area and hazard areas until a pawn piece reaches the green area. Once on the green area, the landing markers are colored thereby identifying the degree of difficulty of skill testing questions on the real game of golf associated with such colored landing markers.

BACKGROUND ART

Various board-type golf games are known and on which are delineated golf links. Also, various ones of these golf games are provided with landing markers which have numbers associated therewith. Such is, for example, described in U.S. Pat. No. 1,546,837, issued Jul. 21, 1925 as well as U.S. Pat. No. 673,080, issued Apr. 30, 1901. These games also illustrate golf links provided with hazard areas, such as described in U.S. Pat. No. 4,042,246 issued on Aug. 16, 1977. In this latter patent there are also shown different paths leading to a green area and on the green area each path is provided with groups of putting positions. The use of dies, as a numerical chance means, is disclosed in this patent. Other chance means associated with these games may be in the form of spinner cards, as is well known in the art. The use of cards and pawn markers is also well known in the art.

SUMMARY OF INVENTION

It is a feature of the present invention to provide a board-type golf game utilizing golf skill testing question cards which contain questions on the real game of golf and which questions are grouped in degrees of difficulties and dependent on the score of the player to reach the green area and also on his specific position on the green area as determined by colored landing markers.

Another feature of the present invention is to provide a board-type golf game which is easy to play and which closely simulates the real game of golf and which permits the players to play different types of matches with each player having a calculated handicap based on previous scores obtained by playing the golf game.

Another feature of the present invention is to provide a board-type golf game wherein the numerical chance means comprises a pair of dies and wherein the player must select to play one or both of these dies dependent on his position on the fairway or hazards of the golf links.

According to the above features, from a broad aspect, the present invention provides a board-type golf game comprising a board having a playing surface on which is delineated a plurality of golf links. Each of the golf links has at least a tee area, a fairway area and a green area. The fairway area has a plurality of landing markers having a different numerical designation and disposed on the fairway area. The green area has at least four landing markers each having a different numerical designation. All of the numerical designations are different from one another. The landing markers have at least a first and a second distinct identity. A plurality of golf skill testing cards having questions associated with each of the first and second distinct identity markers, are also provided. At least one player pawn is provided for positioning over the landing markers. Numerical chance means is also provided to produce golf strokes to cause the player pawn to be displaced over the fairway area and dependent on numerical values obtained by a player actuating the chance means. The skill testing cards are provided in distinct groups corresponding to the numerical score that a player has obtained to place his player pawn on one of the colored landing markers on the green area and within a predetermined score range. The skill testing cards contain groups of educational questions on the real game of golf and causes the player pawn to be displaced or not on the green area.

BRIEF DESCRIPTION OF DRAWINGS

A preferred embodiment of the present invention will now be described with reference to the accompanying drawings in which:

FIGS. 4A and 4B are plan views of a score card and a handicap card associated with the game.

DESCRIPTION OF PREFERRED EMBODIMENTS

Figure 1:
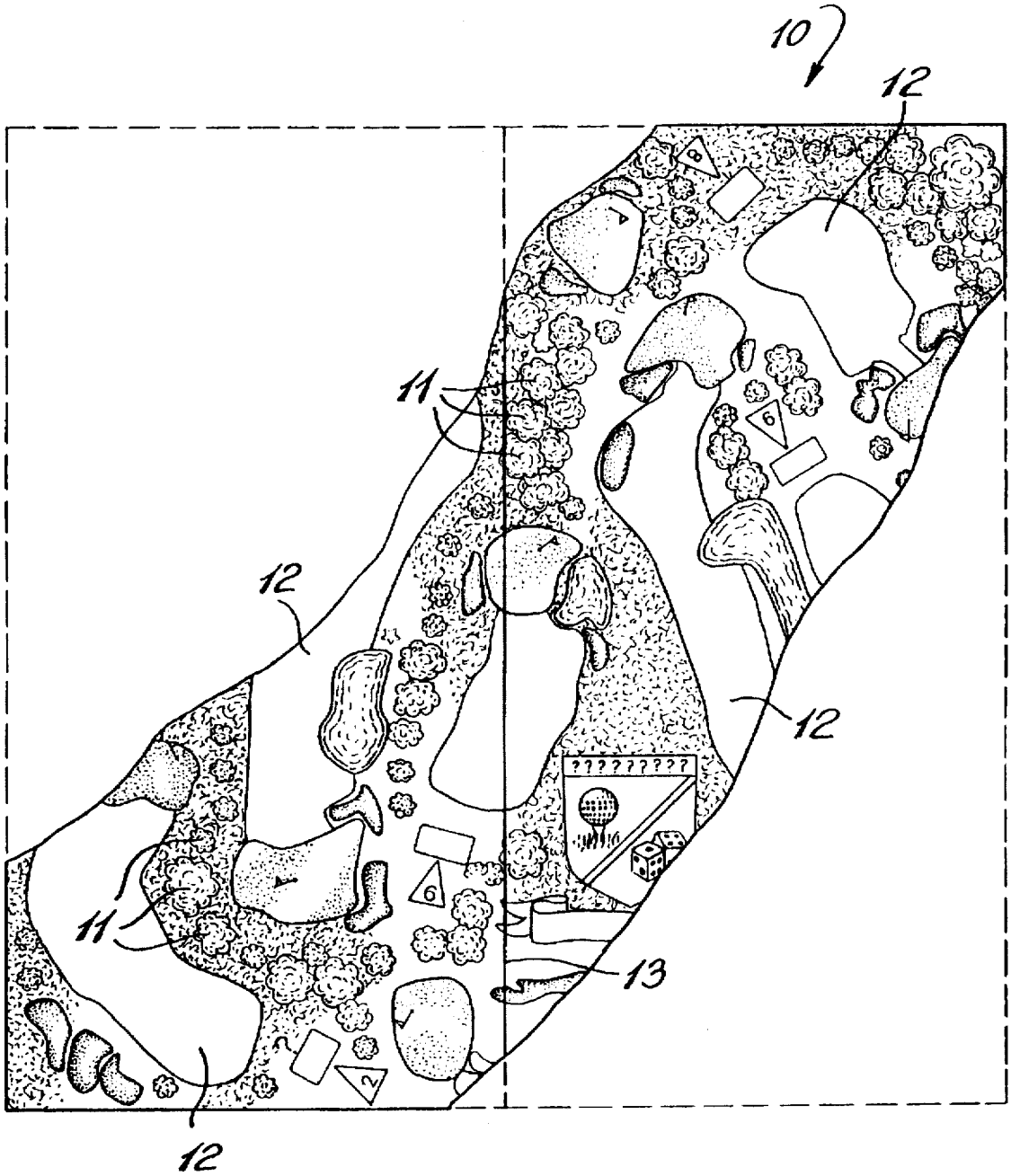
FIG. 1 is a plan view showing the playing board of the golf game of the present invention.

Referring now to the drawings, and more particularly to FIG. 1, there is shown at 10 a rectangular golf game board which is provided with opposed flat playing surfaces, only one of the surfaces, namely surface 11 being shown herein. Golf links 12 are printed or otherwise reproduced such as by photography on each of the opposed playing surfaces 11. The board is also provided with a central fold line 13 whereby it can be folded in half to provide for a more compact packaging of the game.

Figure 2:
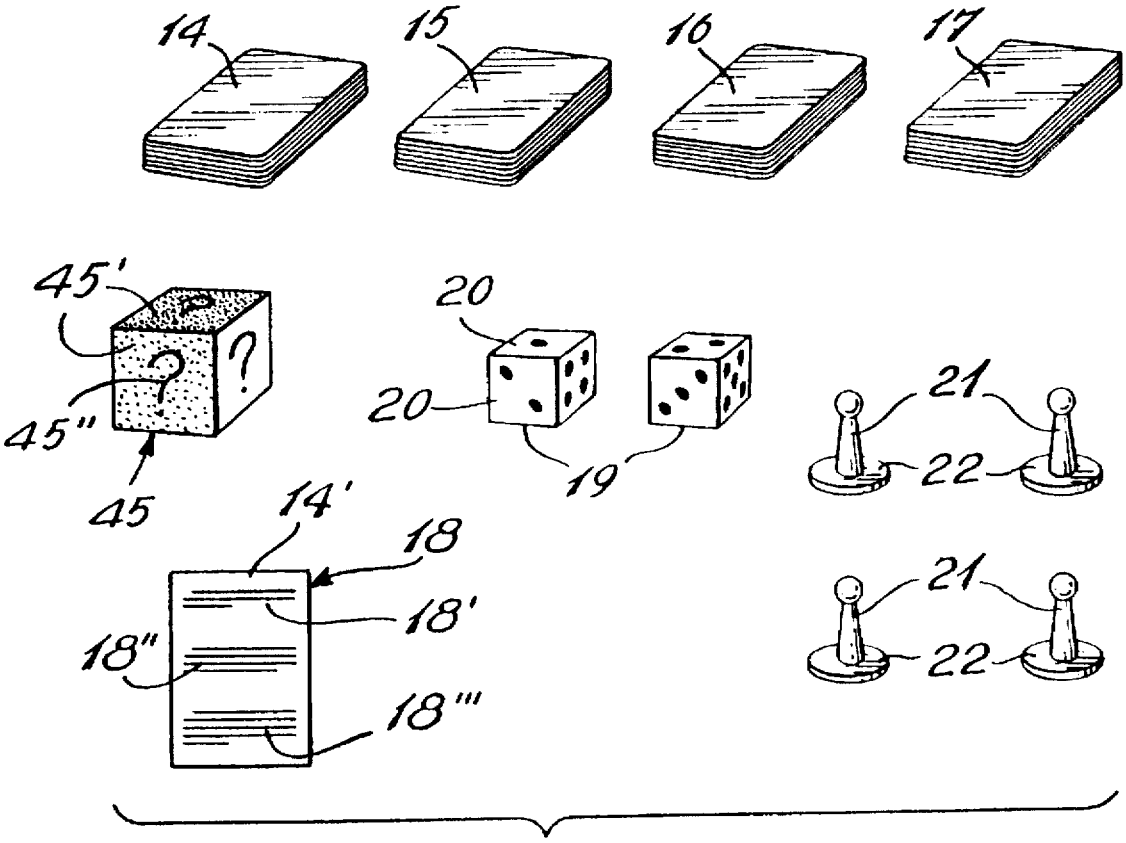
FIG. 2 are perspective views showing different elements which are utilized with the board as shown in FIG. 1 and namely distinct groups of question cards, a bonus die with different colored surfaces, a pair of regular dies with numbers and player pawns.

As shown in FIG. 2, and associated with the board-type golf game of the present invention, there is also provided skill testing cards, herein four different groups of skill testing cards 14', 15, 16 and 17 respectively. Each of these groups of skill testing cards are of different colors to identify one from the other and each group of cards is provided with questions printed thereon such as shown on card 14' by reference numeral 18. The difficulty of the questions as contained in these cards is dependent on the color of the groups of cards. Also, there are three groups of questions 18', 18" and 18'" and each of these groups also having a varying degree of difficulty dependent on the position of a player pawn on the green areas. The colors of the groups of cards are associated with golf scores and there are four distinct colors. One color associated with an "Eagle" score, one with a "Birdie" score, one with a "Par" score, and one with a "Bogey" score. Instead of colors, the card and groups may be differentiated by logos, patterns or other identifying means.

As also shown in FIG. 2, the game comprises a numerical chance means herein provided by a pair of dies 19 each having dots printed on their faces 20 and representative of numbers from 1 to 6. These are the common types of dies that one finds in many amusement games. The golf game also includes at least four player pawn pieces 21 each having a specific identity, herein a color or other identifiable means, whereby to identify one from the other and to associate these with different players. These pawn pieces 21 are also provided with a flat support base 22 whereby these pawn pieces may be positioned upright over landing markers on the playing surface 11 of the game board 10.

Figure 3:
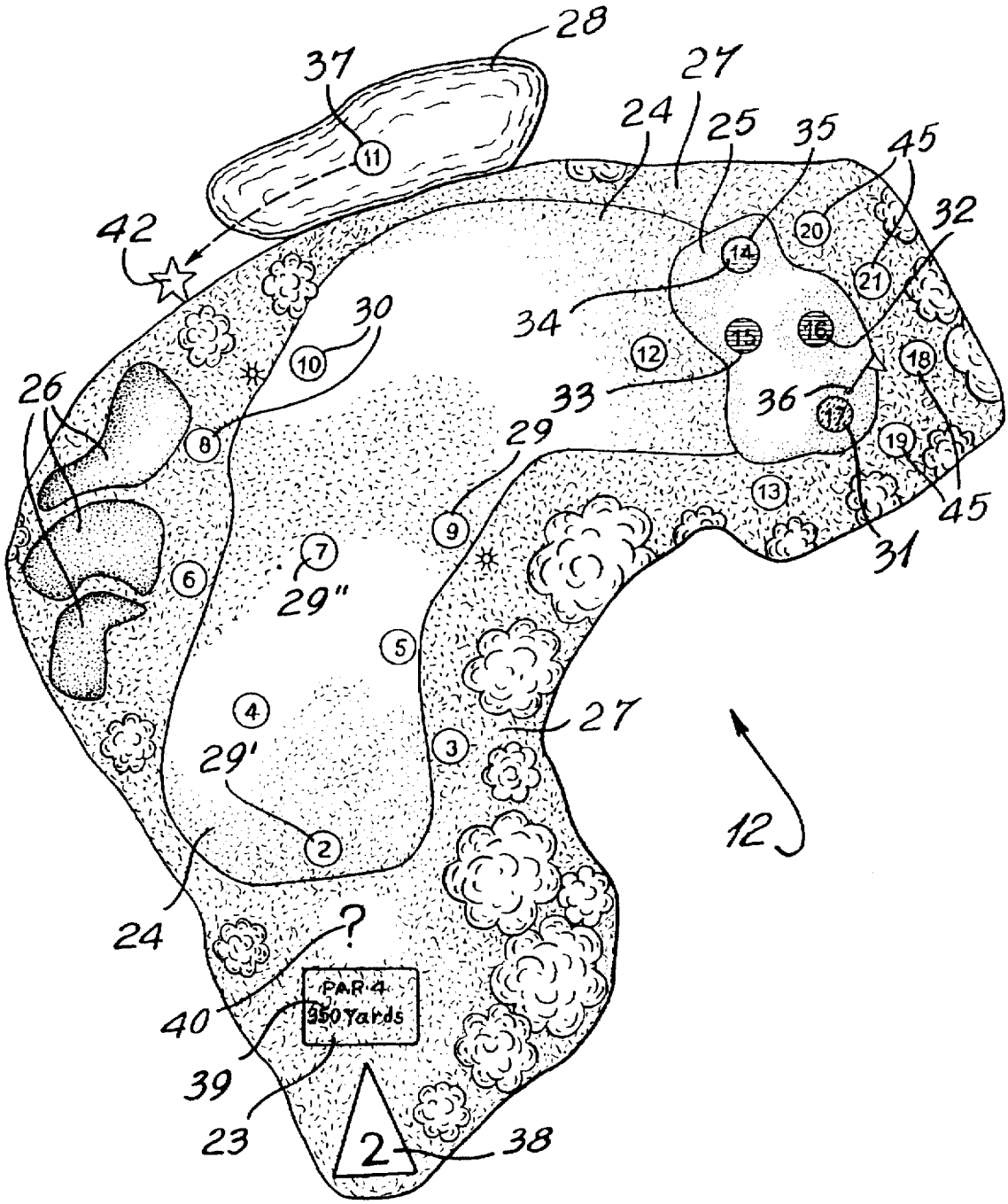
FIG. 3 is a detailed plan view showing the structure of some of the golf links that are printed on the golf game board.

With reference now to the more detailed diagram of the golf links 12 as shown in FIG. 3, a more detailed description of the construction of the golf links will now be described. As hereinshown, each of the golf links 11 has at least a tee area 23, a fairway area 24 and a green area 25. It is also provided with hazard areas such as the sand trap hazard area 26, the rough hazard areas 27 and the water hazard areas 28, all associated with a specific golf link 11.

The fairway areas 24 are each provided with a plurality of landing markers 29 having a different numerical designation 30 and disposed randomly widthwise of the fairway area 24 and into hazard areas and substantially sequentially along a lengthwise direction of the fairway area. Accordingly, the numerical value of the landing marker 29' is inferior to the numerical value of the landing marker 29" which is positioned ahead of the landing marker 29' lengthwise of the fairway as calculated from the tee area 23 to the green area 25. These landing markers may be equidistantly spaced although with this particular game this is not necessary as these are randomly positioned over the golf link as one finds his golf ball during a real game of golf.

The green area 25 has at least four colored landing markers 31, 32, 33 and 34 but only three different colors. Instead of differentiating the landing markers by color, they may have other identifying means such as hatching patterns, shapes, etc. Each of these landing markers 31 to 34 have a different numerical designation 35 therein. The green area is also provided with a golf cup icon 36. The landing markers 29 as found on the fairway area 24 and the landing markers 37 as found in the hazard areas all have a uniform color which is different than the colors of the markers 31 to 34 as found on the green areas.

The distinct colors of the landing markers on the green area are associated with specific skill testing questions 18 as found on the skill testing cards, such as card 14', as shown in FIG. 2. Dependent on the color of these landing markers on the green area, the difficulty of the questions increases as the landing marker is further away from the golf cup icon 36. For example, landing marker 31 which is closest to the golf cup icon would have the least difficult question whereas the landing marker 34 which is the furthest away from the golf cup icon would associate with the most difficult ones of the questions on a specific one of the skill testing cards. The manner in which the skill testing cards are selected depends on the players score in attaining the green area 25. As previously described, these skill testing cards 14–17 are colored, and for example only, the group of cards 14 may be gold colored for an Eagle stroke position of a player, the group of cards 15 may be red for a Birdie stroke position of a player, the group of cards 16 may be white for a Par stroke position of a player and lastly, the group of cards 17 may be of a green color for a player who is in a Bogey stroke position when attaining the green.

The manner in which the game is played will now be described with reference to FIG. 3 on which hole #2 is illustrated. Each hole is provided with a hole designation 38 and the game is played in sequence as is the case with the real game of golf. Also, each hole is provided with a yardage indication 39 associated with the tee area 23. A question mark 40 also provided on some of these holes and it indicates that each player has the option of selecting a bonus card on that hole, as will be described later.

Hole #2 as herein illustrated is a Par 4 hole and if a player, after rolling the dies twice finds himself on the green area and for example on the landing marker 31, which is a red landing marker, he is in a Birdie position. Assuming that the next player has taken four throws of the dies in order to reach the green and is now on the landing marker 34 which is a green marker, he is therefore in a Bogey position. We are assuming that only two players are playing the game. Accordingly, the first player will select a card from the red groups of cards 15 and the other player will ask the first player the question 18' associated with the red landing marker 35 which is closest to the golf cup icon 36 and which is the least difficult one of the questions 18 as shown on the card 14' in FIG. 2. There are only three colors of landing markers on the green and each of these has an increasing difficulty of questions as shown by questions 18', 18" and 18'" in FIG. 2 as previously mentioned. Accordingly, two of the green landing markers 31, 32, 33 and 34 are of the same color. If the skill testing question is correctly answered, the first player adds a single stroke to his score and thus obtains a Birdie or a score of three (3) for the Par 4 hole #2. If the question is incorrectly answered, the player must wait for his turn to answer another question of the same order of difficulty but taken from a different card from the following category of questions from card group 16 of the Par category of skill testing cards. He must also add one more stroke to his score. The second player on landing marker 34 selects from the green pack, say pack 17, and because he is playing for "Bogey" he must answer skill testing question 18'" which is the hardest category question.

Each of the players has the choice of utilizing one or both of the dies 19 each time he is required to play and depending on the position of his marker piece 21 on the golf link. Each number as contained in the landing markers indicates the total die numbers that a player has obtained to reach that landing marker. For example, if a player is on a marker having the designation 10 and wishes to land on the green which has a designation 15, he is required to obtain a die score of not more than five (5) whereby to advance his pawn piece towards that landing marker on the green. If he obtains a three (3), he may find himself in a hazard area and depending on the hazard area, he may be required to take a penalty stroke.

As can be seen from FIG. 3, each of the water hazards, for example water hazard 28 which is provided with a landing marker 37, has associated with that marker a drop area marker 42 which is disposed at a point of entry into the water hazard area 28 and the player must take a penalty stroke when he lands his pawn on marker 37, as is the case in the real game of golf. He will then continue playing from that drop area marker 42.

When a player rolls the die or dies and obtains a number which is superior to the maximum landing marker found on the green area, but falls on one of the four "over-the-green" landing markers 45, he must again roll the dies, therein one die, and subtract the die number obtained from the superior number on the landing marker 45 until his subtracted score corresponds to the number in one of the green area landing markers. Each time a die is rolled, a stroke is added to the player's score.

If a player rolls the dies and obtains a score greater than the largest score of the "over-the-green" landing markers 45, then he is considered to be "out of bounds" and must reposition his player marker at the last landing marker that he was located and he must take a penalty stroke. It is also to be noted that with certain ones of the Par 3 holes, there is the possibility that the player can obtain a hole-in-one as one of the landing markers is positioned directly on the golf cup icon 36. Also, it is to be noted that the pawns of different players can land on the same landing marker.

If a player requires one or more rolls of dies above the Par Rating of the golf link being played in order to position his player pawn on the green area, he must therefore add one additional stroke for his putt and the total is then his final score for that golf link, that player will not have to answer any skill testing question. It is also pointed out that the maximum number of questions that a player may be asked while his player pawn is on a particular green area, is two. If the player does not correctly answer the second question, he must therefore add another stroke for his incorrect second answer and a further stroke to finish his play on the green. He has therefore taken the maximum three putts on the green.

The bonus designation icon 40 appearing on certain ones of the golf links 11 signifies that each player once on the tee area, has the option to participate in a bonus question by rolling the bonus die 45 as shown in FIG. 2. The die 45 is provided with six colored faces 45'. One face 45' has the same color as the card group associated with an "Eagle" score color pack 14, one face with the "Birdie" score color pack 15, two faces with the "Par" color pack 16 and two faces with the "Bogey" color pack 17. The question mark icon 45" is also colored to determine which of the questions in the groups 18', 18" or 18'" he must be asked on the card of the specific colored group that the die falls when rolled. If the player decides to roll the die 45 and correctly answers the bonus question identified, he adds a number 6 to the number he will obtain with his first die throw. Accordingly, if the player on his first die throw obtains a total of eight (8) he may add 6 to it to position his marker on the landing marker 14 which is closer to the green area and this may give him an opportunity to obtain a Birdie or even an Eagle on the hole being played. However, if the player does not correctly answer the bonus question, he must add a stroke to his score on that link. These bonus icons 40 are only available on difficult Par 4's and the Par 5 links.

The players also utilize a standard score card 46, as shown in FIG. 4A to inscribe their score thereon. This is a conventional score card as one finds in the real game of golf and all of the players names and scores are maintained on that card. The card also contains a handicap rating for each of the holes. The game also provides handicap calculating cards 47, as shown in FIG. 4B whereby a player can calculate his handicap from a predetermined number of game scores having previously played. At least five game scores are required to calculate the handicap in accordance with a method as printed on this handicap card.

It can be appreciated that with the golf game of the present invention the players have the opportunity to learn the rules as well as other educational aspects of the real game of golf and which are contained in question form. Also, the game provides for the players to play different matches such as medal play, match play, team play, best ball, Vegas, alternating shots, etc. The players can also play a friendly game such as skins, Nassau, four points, etc.

It is within the ambit of the present invention to cover any obvious modifications of the preferred embodiment described herein, provided such modifications fall within the scope of the appended claims.

I claim:

1. A board-type golf game comprising a board having a playing surface on which is delineated a plurality of golf links; each of said golf links having at least a tee area, a fairway area and a green area; said fairway area having a plurality of landing markers having a different numerical designation, said green area having at least four landing markers each having a different numerical designation, all said numerical designations being different from one another; said landing markers on said green area having at least a first and a second distinct identity, a plurality of golf skill testing cards having questions associated with each said first and second distinct identity, at least one player pawn piece for positioning over said landing markers, and numerical chance means to produce golf strokes to cause said player pawn piece to be displaced over said fairway area to said green area and dependent on numerical values obtained by a player actuating said chance means; said skill testing cards being provided in distinct groups corresponding to the numerical score that a player has obtained to place his player pawn on one of said landing markers on said green area and within a predetermined score range; said skill testing cards containing groups of educational questions on the real game of golf and causing said player pawn piece to be displaced or not on said green area.

2. A golf game as claimed in claim 1 wherein said landing markers on said fairway area are disposed randomly widthwise of said fairway area and substantially sequentially along a lengthwise direction of said fairway area.

3. A golf game as claimed in claim 2 wherein each said golf link is further provided with representations of golf hazards, and wherein at least some of said golf hazards contain one or more landing markers having different numerical designations and unlike those as contained in said fairway and green areas.

4. A golf game as claimed in claim 3 wherein said landing markers on said green area contain a third distinct colored landing marker, said distinct colored landing marker being spaced different distances away from a cup icon marker on said green area, said questions of said golf skill testing cards being associated with said distinct colored landing markers, said landing marker which is closer to said cup icon requiring less skill to answer than said questions associated with said colored landing markers further away from said cup marker.

5. A golf game as claimed in claim 3 wherein there is further provided at least two landing markers beyond said green area, said at least two landing markers having numerical values greater than those on said distinct colored landing markers on said green area.

6. A golf game as claimed in claim 2 wherein said numerical chance means is constituted by a pair of die, each die having facial numerical values of from 1 to 6.

7. A golf game as claimed in claim 6 wherein said landing markers on said green area contain a third distinct identity landing marker, said distinct identity landing marker being spaced different distances away from a cup marker on said green area, said questions of said golf skill testing cards having identity means associated with said identity of said landing marker with said landing marker closer to said cup marker requiring less skill to answer the said questions associated with said identity landing markers further away from said cup marker.

8. A golf game as claimed in claim 7 wherein said identity of said landing markers are color identities.

9. A golf game as claimed in claim 7 wherein each said golf link is further provided with representations of golf hazards, and wherein at least some of said golf hazards contain one or more landing markers having different numerical designations and unlike those as contained in said fairway and green areas.

10. A golf game as claimed in claim 9 wherein said golf hazards comprise rough hazard areas associated with said fairway and green areas, sand trap hazard areas, and water hazard areas.

11. A golf game as claimed in claim 9 wherein said landing markers in said water hazard areas are each provided with a drop area marker.

12. A golf game as claimed in claim 7 wherein there are four groups of skills testing cards, each said groups having a distinct identity, said distinct identity corresponding to a particular score of a player when reaching said green area.

13. A golf game as claimed in claim 12 wherein there is further provided a 6-face bonus die, said bonus die being associated with said four groups of skill testing cards, each said 6-face having a colored icon with a color identifying said identity means of said groups of educational questions on said skill testing cards.

14. A golf game as claimed in claim 12 wherein said distinct groups of skill testing cards are identified from one another by distinct colors.

15. A golf game as claimed in claim 1 wherein there is further provided score cards for each player of said golf game, said golf links having a handicap rating number for each link, and a handicap card for players to calculate their handicap from previous predetermined scores after having played said golf game several times.

16. A golf game as claimed in claim 1 wherein said board is a rectangular board having opposed flat playing surfaces, there being nine of said golf links printed on each of said playing surfaces, said board having a central fold line.

17. A golf game as claimed in claim 1 wherein said player pawn piece is comprised by at least four pawn pieces each having a specific identity to identify one from the other, said pawn pieces having a support base to position same stationary on said landing markers.

* * * * *